US005414452A

United States Patent [19]

Accatino et al.

[11] Patent Number: 5,414,452

[45] Date of Patent: May 9, 1995

[54] RECOGNITION OF INK EXPIRY IN AN INK JET PRINTING HEAD

[75] Inventors: Andrea Accatino, Romano Canavese; Angelo Arca, Cascinette, both of Italy

[73] Assignee: Ing. C. Olivetti & C., S.p.A., Ivrea, Italy

[21] Appl. No.: 68,121

[22] Filed: May 27, 1993

[30] Foreign Application Priority Data

Jun. 8, 1992 [IT] Italy ..... TO92A0485

[51] Int. Cl.[6] ..... B41J 2/175

[52] U.S. Cl. ..... 347/7; 347/87

[58] Field of Search ..... 346/1.1, 75, 140 R; 73/290 R; 347/6, 7, 86, 87, 2

[56] References Cited

U.S. PATENT DOCUMENTS

| | | | |
|---|---|---|---|
| 4,130,126 | 12/1978 | Chocholaty et al. | 346/75 X |
| 4,202,267 | 5/1980 | Heinzl et al. | 346/140 R |
| 5,049,898 | 9/1991 | Arthur et al. | 346/1.1 |
| 5,138,344 | 8/1992 | Ujita | 346/140 R |
| 5,300,969 | 4/1994 | Miura et al. | 346/1.1 |

FOREIGN PATENT DOCUMENTS

| | | | |
|---|---|---|---|
| 0523635 | 1/1993 | European Pat. Off. . | |
| 62-60654 | 3/1987 | Japan | 346/140 R |
| 62-92850 | 4/1987 | Japan | 346/140 R |
| 63-147649 | 6/1988 | Japan | 346/140 R |
| 1-120352 | 5/1989 | Japan | 346/140 R |
| WO90/00974 | 2/1990 | WIPO . | |
| WO92/18335 | 10/1992 | WIPO . | |

*Primary Examiner*—Benjamin R. Fuller
*Assistant Examiner*—John E. Barlow, Jr.
*Attorney, Agent, or Firm*—Banner, Birch, McKie & Beckett

[57] ABSTRACT

In ink jet printers in which the printing head (33) is connected to an ink reservoir (16), such as may be used in teleprinter or facsimile apparatuses, it is necessary to foresee the expiry of the ink in the reservoir in order to be able in due time to replace the printing head or the pertinent cartridge. A logic circuit (40) is used to count the number of drops gradually expelled, and, with any necessary correction, compares this number with the maximum number of drops equivalent to a known volume of ink contained on average in the reservoir. Expiry of the ink is indicated in in dependence on the result of the comparison.

16 Claims, 3 Drawing Sheets

RECOGNITION OF INK EXPIRY IN AN INK JET PRINTING HEAD

FIELD OF THE INVENTION

The present invention relates to a method and device for the recognition of ink expiry in a reservoir of an ink jet printing head.

BACKGROUND OF THE INVENTION

In ink jet printers and in particular in those which receive the data to be printed from separate apparatuses, such as for example a central processing and printing unit for data, or a facsimile apparatus, it is preferable to prevent a situation in which the ink contained in the reservoir of the printing head becomes exhausted unforeseeably, suddenly interrupting any printing operation which is in progress.

Various prior art, methods and devices are known for overcoming the aforementioned disadvantage.

In U.S. Pat. No. 4,202,267 there is described a system for indicating the expiry of the ink in the reservoir of an ink jet printing head, by means of a pair of electrodes on the floor of the ink reservoir and wetted by the ink. The electrodes are connected to a detection circuit to indicate the variations of the electrical resistance of the ink contained between the electrodes. When the ink is close to expiry one of the electrodes becomes uncovered and the detection circuit reveals a very high resistance thereby indicating expiry of the ink. Such a system provides no advance indication of the expiry of the ink as it only indicates when the reservoir is virtually empty. Also it may give false alarms when the sloshing movements caused by the to and fro movement of the head results in one of the electrodes being temporarily uncovered by the ink. Moreover, the presence of the electrodes and of the associated electrical connections complicates the construction of the reservoir and makes the latter more costly.

The European patent application No. 509747 discloses another device for the detection of the ink in the reservoir of an ink jet printing head. In this a pair of electrodes is introduced into the reservoir, which is filled with porous material soaked in ink, in a zone in which the capillarity of the porous material is greater than in the rest of the reservoir. As a result of this, the zone is emptied last as ink is used. In this arrangement the electrodes detect a more rapid increase in the electrical resistance of the ink, thus indicating in advance the impending expiry of the ink.

Such a device, although eliminating some of the disadvantages noted in the system of the aforementioned U.S. patent, such as those caused by the sloshing movement of the ink, proves to be of complex and costly construction as a result of the presence of the electrodes and of the associated electrical contacts.

SUMMARY OF THE INVENTION

A preferred embodiments of the present invention overcome the drawbacks of the prior art by the use of a logic circuit which counts the number of ink drops expelled. This figure may be corrected to take account of ink loss due to evaporation. The figure is then compared with the maximum number of drops expected in the volume of ink contained in the reservoir and advance warning of ink expiry is then given in dependence on the result of the comparison.

The invention is defined with more precision in the appended claims to which reference should now be made.

BRIEF DESCRIPTION OF THE DRAWING

A preferred embodiment of the invention will now be described with reference to the accompanying drawings, in which:

With reference to FIGS. 1 and 2, a carriage 10 of an ink jet printer 11 is slidable on guides 12 in a direction perpendicular to the plane of FIG. 1, and comprises a support 14 for a cartridge 15 comprising a reservoir 16 for the ink and a printing head 33, as will be described hereinbelow.

Figure 1:
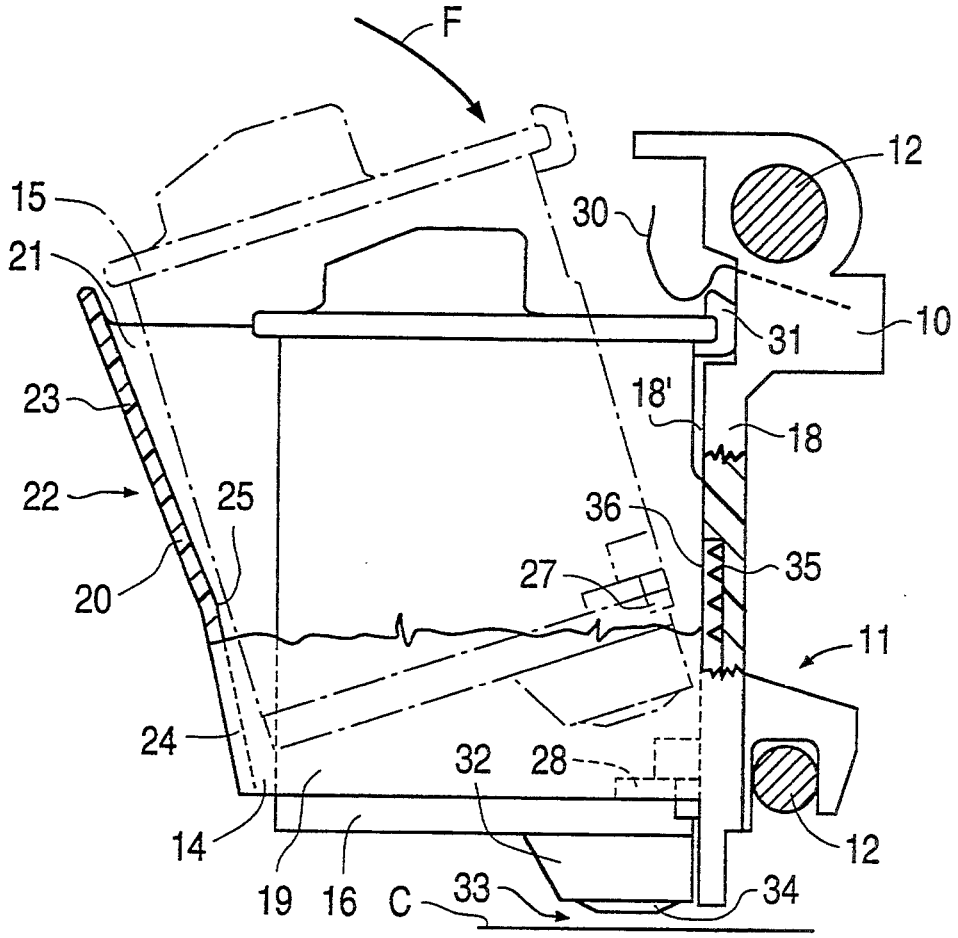
FIG. 1 is a partial cross sectional view of an ink jet head and of its container.

The support 14 is composed of a bracing element 18 integral with the carriage 10 and of three lateral walls 19, 20, 21 forming a container 22 for the cartridge 15, which container is open at the top and at the bottom. The walls 19 and 21 are parallel to one another and are linked to the bracing element 18, while the wall 20 is convergent towards the bottom of FIG. 1, to facilitate the insertion and the extraction of the cartridge 15. In particular, the wall 20 comprises two portions 23 and 24 which are flat and differently inclined one with respect to the other and which form a ridge 25 extending the full width of the wall 20, parallel to the guides 12.

The ridge 25 has the function of guiding the cartridge 15 during introduction. The cartridge 15 is manually introduced with an inclined position indicated by the dot-dash line in such a manner that it executes by gravity a rotation indicated by an arrow F. At the conclusion of its introduction, the cartridge has positioned itself correctly in the container 22 by means of a reference and hooking tooth 27, which is coupled with an arresting component 28 solid with each one of the walls 19 and 21 and projecting into the interior of the container 22.

Finally, the cartridge 15 is locked against the brace 18 by means of a spring 30, which detains a projection 31 of the cartridge 15.

The cartridge 15 may be of the type in which its own reservoir 16 contains a spongy body soaked in ink and integrally carrying in a lower projecting part 32 an ink jet printing head 33. The printing head 33 may be of any ink jet type and in particular of the thermal type composed of a multilayer plate 34 containing one or more cells for the ink, which are linked to corresponding nozzles and which each contain a resistive or heater element. Each drop of ink is expelled through a nozzle by the effect of a rapid heating of a resistive element contained in the corresponding cell. These resistive elements are activated selectively by means of electrical pulses sent down a flat cable 35 fixed at one of its ends to the internal face 18' of the bracing element 18.

When the cartridge 15 is inserted into the container 22, in the position shown in solid lines in FIG. 1, the cable 35 is pressed against a corresponding contact set 36, which is fixed externally to a wall of the cartridge 15, and electrically connected to the resistive elements of the head 33. The flat cable 35 is connected at another end 37 to a printed circuit board 40 (FIG. 2) mounted on the structure, not visible, of the printer, which board contains the electrical circuit with the pertinent electronic components for the processing and the printing of information on a medium C and for the management of the motion of the carriage 10, and in particular for the monitoring of the ink in the cartridge 15.

As in ink jet printers a requirement which is particularly felt is that of obtaining as rapidly as possible the drying of the ink deposited on a printed page, there has been widespread use of rapid-evaporation inks of the type, for example, based on liquids with low surface tension and endowed with a high capacity for penetration into the printing medium.

When the cartridge 15 has been charged with such inks, a certain quantity of ink evaporates from the cartridge during the period in which the latter is mounted on the printer. Accordingly, as the physico/chemical characteristics of the ink change, there is also a change in its rate of evaporation.

Figure 3:
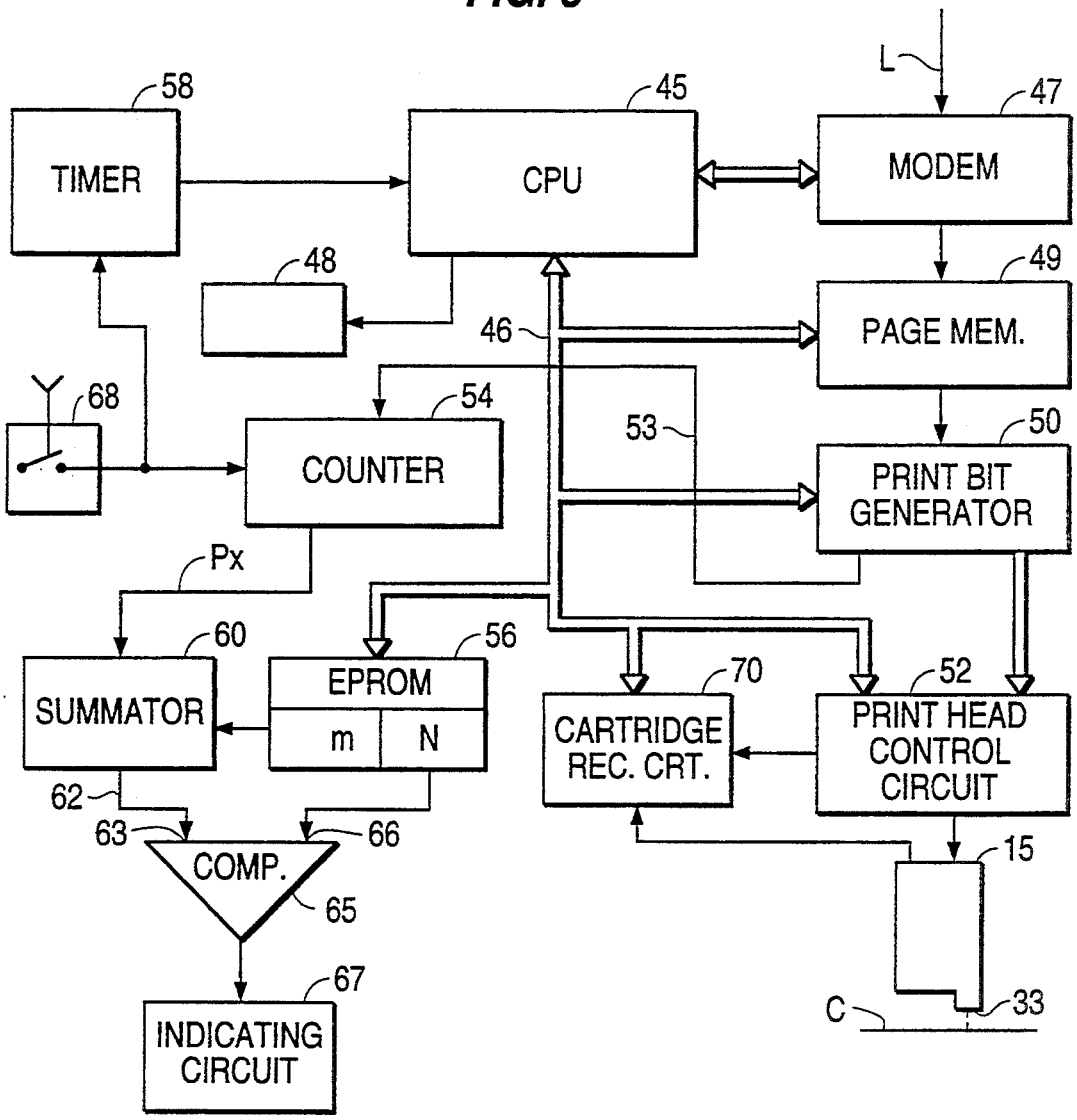
FIG. 3 is a block diagram of a circuit for the recognition of the expiry of ink embodying the invention.
Figure 2:
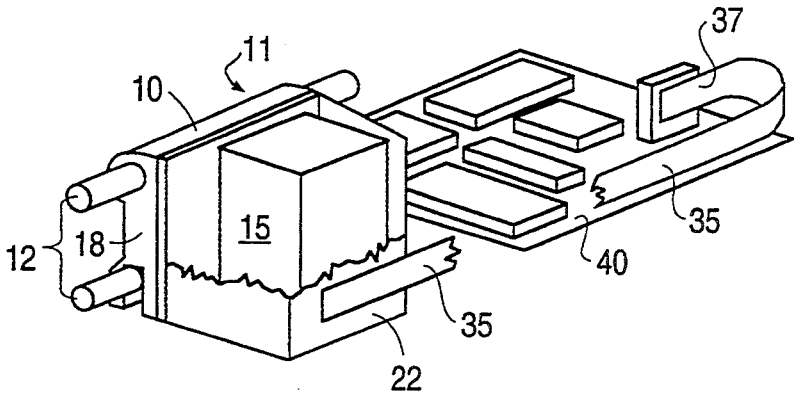
FIG. 2 is a partial representation of the carriage for an ink jet printing head utilising a method of recognition of the expiry of the ink embodying the invention.

FIG. 3 shows a block diagram of a circuit part of FIG. 2, with the pertinent functional units, which are designed to perform the precautionary monitoring of the expiry of the ink in the cartridge 15, for the purpose of preventing unforeseen exhaustion of the ink and consequent loss of information, which cannot be printed. The block diagram of FIG. 3 refers on an illustrative and nonlimiting basis to an apparatus for the remote transmission of data on a line L, such as for example a teleprinter or a facsimile apparatus.

In a known manner, a central processing unit (CPU) 45 superintends the performance of all the functions of the various logic components of the circuit, passing to each one of them on a bus 46, address and command signals.

The data arriving down the line L are demodulated and decoded by a circuit 47 (MODEM) and temporarily stored in a so called page memory 49. Under the control of the central unit 45, the stored data are processed by a circuit 50 called a print bit generator, and converted into groups of bits or pixels which are suitable to be then passed to a circuit 52 for actuating the printing head 33.

From the print bit generator 50, the signals, in the form of pulses, corresponding to the bits to be printed, are passed serially on a conductor 53 to a counter 54, which progressively counts their number, indicated by Px. To each pulse there thus corresponds one ink drop which is expelled from each nozzle of the head 33. In a memory 56 of programmable type (EPROM) there are stored, in the course of the construction of the circuit 40, two numbers m and N, which are defined as follows:

m=number of ink drops equivalent to the quantity of ink which evaporates from the cartridge 15 in a defined time, for example in 24 hours; m is dependent upon the type of ink which is used;

N=number of ink drops which can be emitted from the nozzles of the head 33 which are equivalent to the quantity of ink contained in the reservoir. In particular, N is calculated from the ratio between the minimum volume of ink contained in the cartridge 15 and the maximum value of each drop expelled from the nozzles.

The terms 'minimum volume of ink' and 'maximum volume of the drops expelled' refer to the result of statistical processings of measurements made on a large number of cartridges and of printing heads of the same type. A programmable clock circuit (TIMER) 58 is regulated in such a manner as to pass to the central unit 45 one pulse each time the aforementioned defined time elapses, for example every 24 hours, on the basis of which the memory 56 transfers to a summator circuit 60 the number m, which is added to the number Px of pixels which has been counted by the counter 54 up to that moment. An output 62 of the summator 60 is connected to an input 63 of a comparator 65, whose second input 66 is connected to the memory 56 to receive the number N. When the sum m+Px=N, the comparator 65 activates an indicating circuit 67 to warn the operator to replace the ink cartridge.

When such replacement has been made, the operator activates a switch 68, which resets the counter 54 and the clock 58.

The ink expiry regulating circuit of FIG. 3 further comprises a circuit 70 for the recognition of the type of cartridge inserted into the container of FIG. 1. In fact, various types of cartridge may be used in the printer of FIG. 2 and subjected to the method of the present invention, for example cartridges which are integral with or separable from the printing head; cartridges containing a spongy body soaked in ink or totally filled with ink; cartridges with or without internal electrodes for measuring the quantity of ink contained, etc.

To be able to distinguish the various types of cartridges inserted into the container, the corresponding printing head contains one or more resistive elements which are not connected with nozzles for expulsion of ink drops, which resistive elements are probed by suitable signals sent down the flat cable 35 from the circuit 70 through the actuation circuit 52.

Figure 4:
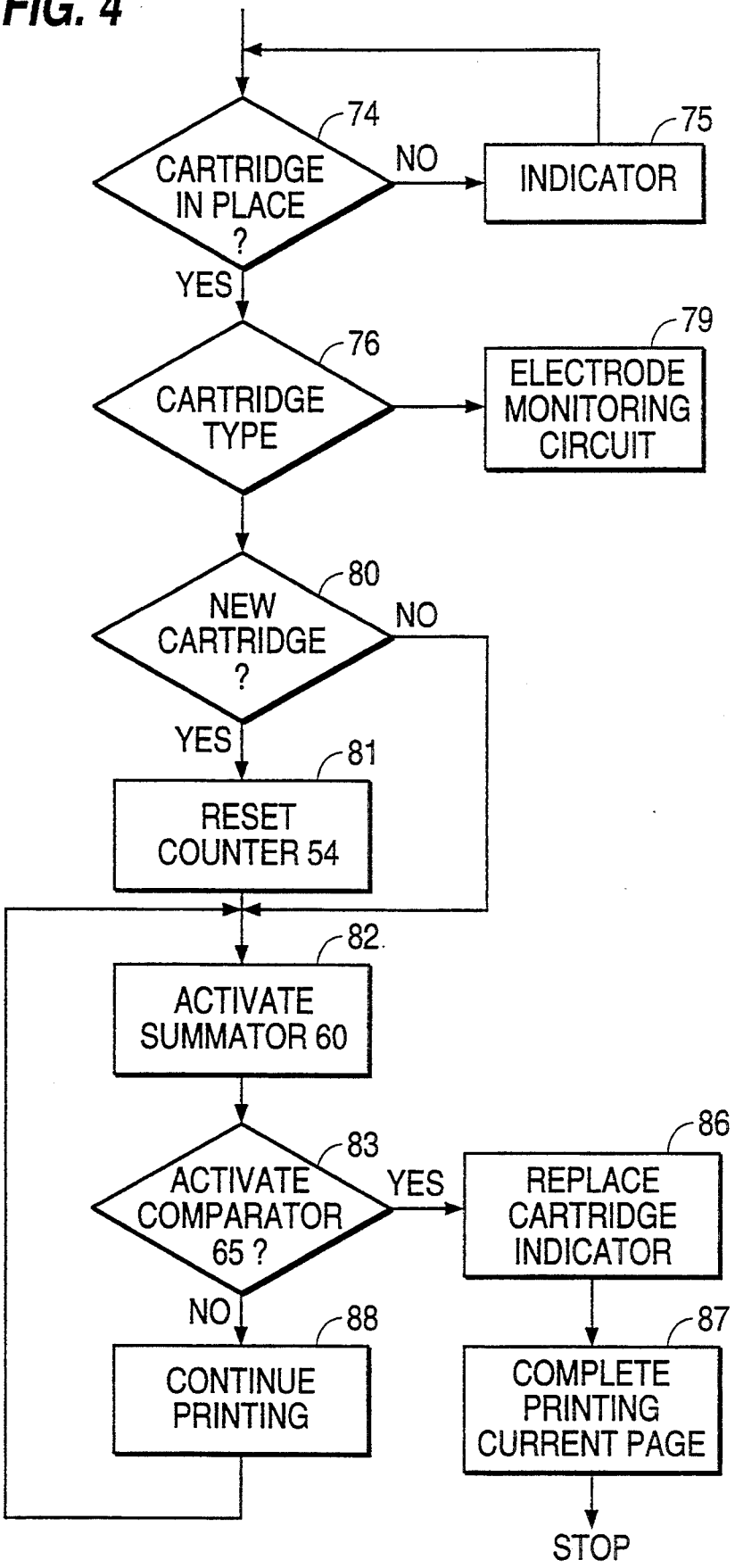
FIG. 4 is a flow diagram of the operations performed by the circuit of FIG. 1.

FIG. 4 shows the logic succession of the operations performed by the circuit of FIG. 3 to realise the method of recognition of the expiry of the ink according to the invention.

By means of the interrogation unit 74, the central unit 45 verifies whether the cartridge 15 and the pertinent printing head 33 are in their seating, by means of the monitoring of the electrical continuity of the circuit of certain resistive elements of the head.

If it emerges that the cartridge is not in its seating, the command to insert a cartridge is indicated by the unit 75.

By means of the interrogation unit 76, the unit 45 determines the type of cartridge inserted. If it identifies a cartridge provided with electrodes for the automatic monitoring of the ink, the central unit 45 activates an appropriate circuit, not shown in the drawings and represented in FIG. 4 by the unit 79.

If, however, the unit 76 identifies a cartridge without the electrodes for monitoring the ink, the unit 45 asks the operator through the interrogation unit 80 and by means of a display 48 (FIG. 3), whether the cartridge is new, i.e. whether it has been replaced. If the response is YES, the operator at the unit 81 activates the switch 68 to reset the counter 54 and the clock 58. If the response is NO, i.e. if the operator does not activate the switch 68 within a certain time, the unit 45 proceeds to activate the summator 60 at the unit 82 and the comparator 65 at the unit 83.

If the outcome of the comparison of the unit 83 is positive, i.e. if the sum of the drops printed and of those equivalent to the evaporation is equal to or exceeds the volume of ink of the cartridge, measured as stated hereinabove, the unit 45 activates an indication to replace the cartridge (unit 86). At the same time, the printer is reactivated to complete the printing of the page in progress (unit 87), since on the basis on which the number N is calculated there is a high probability that in the cartridge to be replaced there is still a certain quantity of ink sufficient to print at least one standard page of characters.

If the outcome of the comparison made by the comparator 65 and indicated by the unit 83 is negative, this means that the cartridge is not yet exhausted and therefore the unit 45 commands the printer to continue printing (unit 88) .

We claim:

1. A method for recognition of expiry of ink in a reservoir (16) of an ink jet printing head in which drops of ink are expelled from a nozzle in response to electrical pulses, comprising the steps of:

counting a number of drops progressively expelled in response to the pulses;

adding to said number a second number of drops (m) equivalent to ink evaporated from the reservoir to obtain a total number of drops; and generating an ink expiry signal when the total number of drops is equal to or exceeds a known volume of ink in said reservoir, expressed as a number of equivalent drops (N).

2. A method according to claim 1, wherein said ink has rapid drying characteristics.

3. A method for recognition of expiry of ink in a reservoir of an ink jet printing head in which drops of ink are expelled in response to electrical pulses, comprising the following steps:

a) counting a number of pulses progressively applied to said head to expel corresponding drops of ink;

b) storing a first number (N) corresponding to how many drops of ink can be expelled with a known quantity of ink contained in the reservoir;

c) storing a second number (m) corresponding to how many drops of ink are equivalent to a volume of ink which can evaporate in a predetermined interval of time;

d) calculating a sum from the second number and the number of pulses;

e) comparing the sum with the first number;

f) generating an ink expiry signal when the sum is equal to or exceeds the first number; and g) completing any printing operation in progress.

4. A method according to claim 3, wherein step a) further comprises resetting the number of pulses on each occasion that the head is replaced by a new head.

5. A method according to claim 3, wherein said predetermined interval of time is defined by a programmable clock.

6. A method according to claim 5, wherein said clock is reset on each occasion that the head is replaced by a new head.

7. A device for recognition of expiry of ink in a reservoir of a printing head suitable for an ink jet printing of information comprising:

a generator of printing pulses corresponding to the information;

a counter connected to said pulse generator to define a number of pulses progressively applied to said head;

a memory containing a first number (N) corresponding to how many drops of ink can be expelled with a known quantity of ink in said reservoir and a second number (m) corresponding to how many drops of ink are equivalent to a volume of ink which can be evaporated in a predetermined interval of time;

a summator circuit connected to said counter and to said memory and capable of defining a sum of said second number and said number of pulses; and, a comparator circuit (65) connected to said summator and to said memory to compare said sum with the first number.

8. A device according to claim 7, wherein said ink has rapid drying characteristics.

9. A device for recognition of expiry of ink in a reservoir of a printing head suitable for an ink jet printing of information, wherein said head is replaceable, the device comprising:

a generator circuit of printing pulses corresponding to said information;

a counter connected to said pulse generator circuit to define a number of pulses progressively applied to said head;

a memory containing a first number (N) corresponding to how many drops of ink can be expelled with a known quantity of ink in said reservoir and a second number (m) corresponding to how many drops of ink are equivalent to a volume of ink which can be evaporated in a predetermined interval of time;

a clock circuit programmed to define said interval of time as from any new replacement of said head;

a summator circuit connected to said counter and to said memory and capable of defining a sum of said first number and of said number of pulses; and, a comparator circuit connected to said summator and to said memory to compare said sum with said first number.

10. A device according to claim 9, comprising means for resetting said counter on each occasion that the head is replaced by a new one.

11. A device according to any one of claims 9, wherein said printing pulse generator circuit (50) is connected to a memory of data to be printed, and the memory is connected to a demodulator circuit capable of decoding signals received from a telecommunication line (L).

12. A device according to claim 11, wherein said line is a telephone line.

13. A device according to any one of claim 7 or 9, wherein said head comprises at least one nozzle for expelling ink drops.

14. A device according to claim 13, wherein said head comprises at least one energy generating element connected with the nozzle to expel ink drops from the nozzle in response to electrical pulses applied to the generating element.

15. A device according to claim 14, wherein said energy generating element converts the electrical pulses into thermal energy.

16. A device according to any one of claim 7 or 9, comprising a recognition circuit capable of discriminating a head containing electrodes for automatic monitoring of ink in the reservoir from a head lacking the electrodes and capable of resetting the counter when the recognition circuit recognizes a head lacking the electrodes.

* * * * *